US006457592B1

(12) United States Patent
Rozen

(10) Patent No.: US 6,457,592 B1
(45) Date of Patent: Oct. 1, 2002

(54) OVERSIZED TOOTHBRUSH HOLDER

(76) Inventor: Richard W. Rozen, 9591 Fenton, Redford, MI (US) 48239

( * ) Notice: Subject to any disclaimer, the term of this patent is extended or adjusted under 35 U.S.C. 154(b) by 0 days.

(21) Appl. No.: 09/934,148

(22) Filed: Aug. 21, 2001

(51) Int. Cl.[7] ..... A47F 7/00

(52) U.S. Cl. ..... 211/65; 248/110; D6/528; D6/531; D6/534

(58) Field of Search ..... 211/65, 66, 87.01; 248/110, 111; D6/528, 531, 534

(56) References Cited

U.S. PATENT DOCUMENTS 2,807,431 A * 9/1957 McHale
2,970,720 A * 2/1961 Dooley
3,915,525 A 10/1975 Taube
4,121,798 A * 10/1978 Schumacher et al.
D278,777 S * 5/1985 Martin ..... D6/534
4,722,113 A * 2/1988 Olsson ..... 211/66 X
5,269,420 A * 12/1993 Harrison et al. ..... 248/110 X
5,369,835 A * 12/1994 Clarke ..... 248/110 X
D358,287 S 5/1995 Sharpe
5,573,019 A 11/1996 Hempel
5,609,259 A 3/1997 Menard
5,675,859 A * 10/1997 Bane ..... 248/111 X
5,740,929 A * 4/1998 Frankel ..... D6/531 X
6,394,285 B1 * 5/2002 Arthurs et al.

* cited by examiner

*Primary Examiner*—Robert W. Gibson, Jr.
(74) *Attorney, Agent, or Firm*—Henderson & Sturm LLP

(57) ABSTRACT

An attachment for a standard wall mounted toothbrush holder. The attachment includes an elongated body member with a proximal end attached to the planar surface of the toothbrush holder, and a distal end with an aperture large enough to accommodate the oversized handle of an oversized toothbrush. In one embodiment the aperture defines a closed loop and in another embodiment it defines an open slot. A notch is provided in the underside of the body member that matingly engages the raised peripheral rim of the planar surface.

6 Claims, 1 Drawing Sheet

OVERSIZED TOOTHBRUSH HOLDER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toothbrush holders, and more particularly to an attachment to a standard toothbrush holder to accommodate oversized toothbrushes.

2. Description of Related Art

As can be seen by reference to the following U.S. Pat. Nos. Des. 358,287; 3,915,525; 5,573,019; and 5,609,259, the prior art is replete with myriad and diverse toothbrush holders.

Toothbrushes are currently being made with oversized handles that are too large to fit into the existing toothbrush holders mounted on bathroom walls.

While all of the aforementioned prior art constructions are more than adequate for the basic purpose and function for which they have been specifically designed, they are uniformly deficient with respect to their failure to provide a simple, efficient, and practical attachment for a standard toothbrush holder to accommodate oversized toothbrushes.

As a consequence of the foregoing situation, there has existed a longstanding need for a new and improved toothbrush holder attachment for oversized toothbrushes and the provision of such a construction is a stated objective of the present invention.

BRIEF SUMMARY OF THE INVENTION

Briefly stated, the present invention provides an attachment for a standard wall mounted toothbrush holder. The attachment includes an elongated body member with proximal end attached to the planar surface of the toothbrush holder, and a distal end with an aperture large enough to accommodate the oversized handle of an oversized toothbrush. In one embodiment the aperture defines a closed loop and in another embodiment it defines an open slot. A notch is provided in the underside of the body member that matingly engages the raised peripheral rim of the planar surface.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
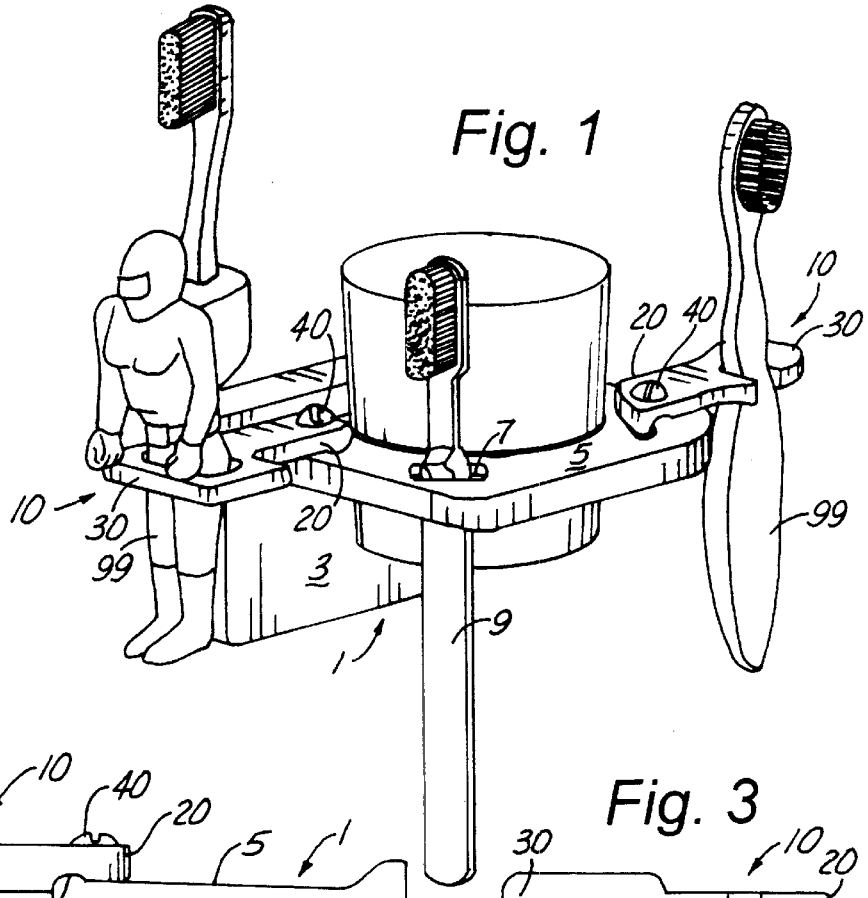
FIG. 1 is a perspective view showing two embodiments of the attachment secured to the planar surface of a standard toothbrush holder.

As can be seen by reference to the drawings, and in particularly to FIG. 1, the attachment for a standard toothbrush holder that forms the basis of the present invention is designated generally by the reference number 10.

Figure 2:
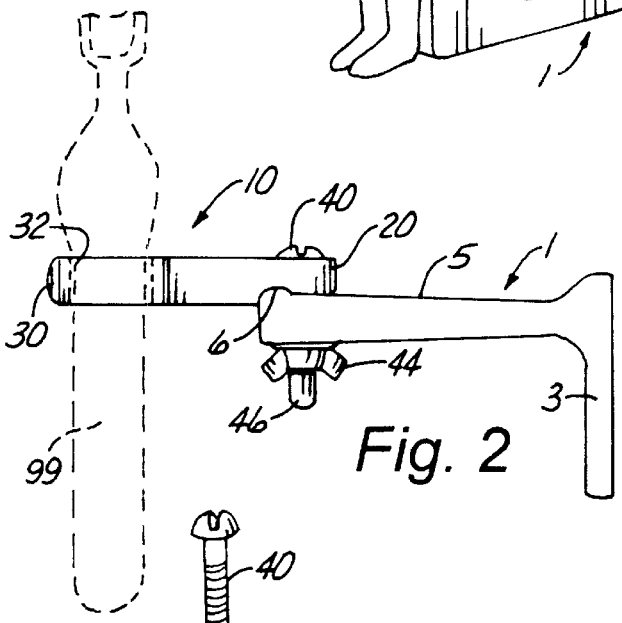
FIG. 2 is a side elevational view.

The attachment 10 is used in combination with a standard wall-mounted toothbrush and cup holder I having a vertical mounting flange 3, a planar surface 5, and a plurality of openings 7 to receive a handle 9 of a standard toothbrush. As illustrated in FIG. 2, the planar surface 5 may have a raised peripheral rim 6.

The attachment 10 includes an elongated body member having a proximal end 20 with a first aperture 22 formed therethrough, and a distal end 30 with a second aperture 32 formed therethrough. As best shown in FIG. 2, the first aperture 22 is vertically aligned with one of the openings 7 in the planar surface 5, and the second aperture 32 is horizontally spaced out from the planar surface 5 and is disposed to receive the oversized handle 99 of an oversized toothbrush. A notch 24 in the underside of the proximal end 20 engages the rim 6 of the planar surface 5.

Figure 3:
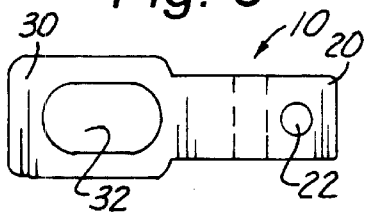
FIG. 3 is a top plan view of a first embodiment of the attachment.
Figure 4:
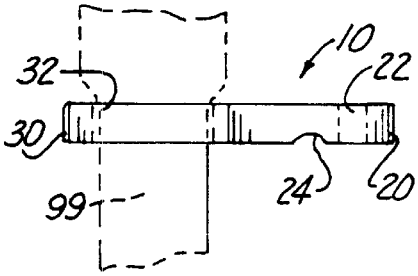
FIG. 4 is a side elevational view thereof.
Figure 5:
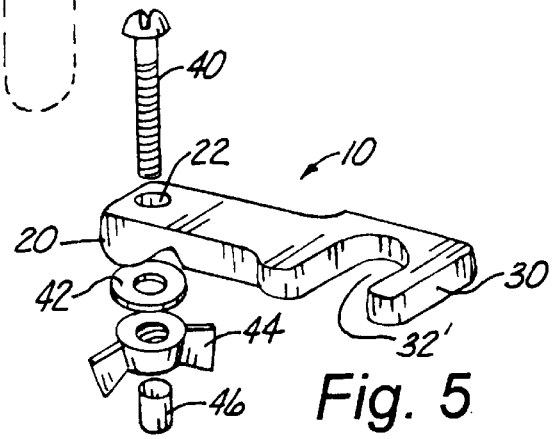
FIG. 5 is an exploded perspective view of a second embodiment showing the fastener components.

The attachment 10 is secured to the standard toothbrush holder 1 by a fastener system that includes a stainless steel bolt 40, washer 42, wing nut 44 and rubber cap 46. FIG. 3 shows an embodiment where the second aperture 32 defines a closed loop, and FIG. 5 shows an embodiment where the second aperture 32' defines an open slot.

The attachment 10 may be easily attached to an existing toothbrush holder 1 by the fastener system so that the second aperture 32 or 32' is disposed to conveniently receive the oversized handle 99 of an oversized toothbrush. The attachment 10 may be made of plastic in any desired shape to suit a variety of preferences.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. In combination with a wall-mounted toothbrush holder having a planar surface with a plurality of openings each disposed to receive a handle of a toothbrush, an attachment comprising:

an elongated body member having a proximal end with a first aperture formed therethrough and a distal end with a second aperture formed therethrough, the first aperture being disposed over and vertically aligned with one of the openings in the planar surface and being disposed to receive a fastener, the second aperture being disposed at a position spaced horizontally out from the planar surface and being disposed to receive an oversized handle of an oversized toothbrush.

2. The combination of claim 1 wherein the second aperture defines a closed loop.

3. The combination of claim 1 wherein the second aperture defines an open slot.

4. The combination of claim 1 wherein the planar surface includes a raised peripheral rim, and the body member includes a notch disposed to matingly engage a portion of the rim.

5. The combination of claim 2 wherein the planar surface includes a raised peripheral rim, and the body member includes a notch disposed to matingly engage a portion of the rim.

6. The combination of claim 3 wherein the planar surface includes a raised peripheral rim, and the body member includes a notch disposed to matingly engage a portion of the rim.

* * * * *